US010619936B2

(12) United States Patent
Schwalm

(10) Patent No.: US 10,619,936 B2
(45) Date of Patent: Apr. 14, 2020

(54) HIGH PRESSURE COUNTERFLOW HEAT EXCHANGER

(71) Applicant: Hamilton Sundstrand Corporation, Charlotte, NC (US)

(72) Inventor: Gregory K. Schwalm, Avon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 154 days.

(21) Appl. No.: 15/008,074

(22) Filed: Jan. 27, 2016

(65) Prior Publication Data

US 2017/0211889 A1 Jul. 27, 2017

(51) Int. Cl.

| | |
|---|---|
| ***F28D 9/00*** | (2006.01) |
| ***F28F 3/02*** | (2006.01) |
| ***F28F 3/06*** | (2006.01) |
| ***F28F 3/08*** | (2006.01) |

(52) U.S. Cl.

CPC ..... *F28D 9/0093* (2013.01); *F28D 9/0068* (2013.01); *F28F 3/025* (2013.01); *F28F 3/06* (2013.01); *F28F 3/08* (2013.01); *F28F 2250/104* (2013.01); *F28F 2250/108* (2013.01)

(58) Field of Classification Search

CPC ..... F28D 9/0093; F28D 9/0068; F28F 3/08; F28F 3/025; F28F 3/06; F28F 2250/104; F28F 2250/108

See application file for complete search history.

(56) References Cited

U.S. PATENT DOCUMENTS

| | | | | |
|---|---|---|---|---|
| 2,875,986 A | | 3/1959 | Holm | |
| 3,983,191 A | * | 9/1976 | Schauls | F25J 5/002 261/114.1 |
| 7,328,740 B2 | | 2/2008 | Leeson et al. | |
| 7,669,643 B2 | | 3/2010 | Ekelund et al. | |
| 8,844,610 B2 | | 9/2014 | Platt | |
| 2007/0289726 A1 | * | 12/2007 | Jibb | F25J 3/04284 165/165 |

FOREIGN PATENT DOCUMENTS

| | | |
|---|---|---|
| FR | 2809805 A1 | 12/2001 |
| GB | 1205933 A | 9/1970 |
| JP | H07180985 A | 7/1995 |

OTHER PUBLICATIONS

Description FR2809805 machine translation.*

Extended European Search Report dated Jun. 7, 2017, issued during the prosecution of corresponding European Patent Application No. EP 17153316.9 (6 pages).

* cited by examiner

*Primary Examiner* — Gordon A Jones

(74) *Attorney, Agent, or Firm* — Locke Lord LLP; Scott D. Wofsy; Georgi Korobanov

(57) ABSTRACT

A heat exchanger including a plurality of heat exchanger plates in a stacked arrangement. At least two counterflow sections are positioned adjacent each other. The counterflow sections comprise an intermediate section of each heat exchanger plate. The heat exchanger plates configured to transfer heat between a first fluid and a second fluid flowing in an opposite directions from the first fluid through a respective heat exchanger plate. At least one tent section is positioned on each end of each counterflow section. The tent sections are configured to angle the flow direction of the first and second fluids in the tent sections relative to the flow direction in the counterflow sections.

5 Claims, 4 Drawing Sheets

HIGH PRESSURE COUNTERFLOW HEAT EXCHANGER

BACKGROUND OF THE INVENTION

1. Field of the Invention

The present disclosure relates to heat exchangers, and more particularly to counterflow heat exchangers.

2. Description of Related Art

Heat exchangers such as, for example, tube-shell heat exchangers, are typically used in aerospace turbine engines. These heat exchangers are used to transfer thermal energy between two fluids without direct contact between the two fluids. In particular, a primary fluid is typically directed through a fluid passageway of the heat exchanger, while a cooling or heating fluid is brought into external contact with the fluid passageway. In this manner, heat may be conducted through walls of the fluid passageway to thereby transfer thermal energy between the two fluids. One typical application of a heat exchanger is related to an engine and involves the cooling of air drawn into the engine and/or exhausted from the engine.

Counterflow heat exchangers include layers of heat transfer elements containing hot and cold fluids in flow channels, the layers stacked one atop another in a core, with headers attached to the core, arranged such that the two fluid flows enter at different locations on the surface of the heat exchanger, with hot and cold fluids flowing in opposite directions over a substantial portion of the core. This portion of the core is referred to as the counterflow core section. A single hot and cold layer are separated, often by a parting sheet, in an assembly referred to as a plate. One or both of the layers in each plate contains a tent fin section that turns the flow at an angle relative to the direction of the flow in the counterflow fin section in the center of the plate, such that when the plates are stacked together into a heat exchanger assembly, both hot and cold fluid flows are segregated, contained and channeled into and out of the heat exchanger at different locations on the outer surface of the heat exchanger.

This counterflow arrangement optimizes heat transfer for a given amount of heat transfer surface area. However, counterflow heat exchangers require a means to allow the flow to enter and exit the counterflow portion of the heat exchanger that also segregates the hot and cold fluids at the inlets and outlets of the heat exchanger; this is typically achieved with tent fin sections at an angle relative to the counterflow core fin section. To maintain practical duct sizes to channel fluid to and from the heat exchanger, a narrow tent section width is desirable; however, because a minimum distance between fins must be maintained throughout the core and tents for structural reasons, pressure drop through the tents of a counterflow heat exchanger is often undesirably high, resulting in an undesirably large heat exchanger volume and weight.

Such conventional methods and systems have generally been considered satisfactory for their intended purpose. However, there is still a need in the art for improved heat exchangers with reduced pressure drop through the tent sections. The present disclosure provides a solution for this need.

SUMMARY OF THE INVENTION

A heat exchanger including a plurality of heat exchanger plates in a stacked arrangement. At least two counterflow sections are positioned adjacent each other. The counterflow sections comprise an intermediate section of each heat exchanger plate. The heat exchanger plates configured to transfer heat between a first fluid and a second fluid flowing in an opposite directions from the first fluid through a respective heat exchanger plate. At least one tent section is positioned on each end of each counterflow section. The tent sections are configured to angle the flow direction of the first and second fluids in the tent sections relative to the flow direction in the counterflow sections. A wall can be positioned between adjacent tent sections and adjacent counterflow section configured to provide a load path at opposite ends of the heat exchanger to oppose forces due to pressure on the tent sections.

At least two inlet ports can be configured to allow the first fluid to enter the heat exchanger and at least two outlet ports configured to allow the first fluid to exit the heat exchanger. Each inlet port and outlet port of the first fluid positioned through a respective tent. The inlet ports of the first fluid can be separated by the wall and the outlet ports of the first fluid can be separated by the wall.

At least two inlet ports can be configured to allow the second fluid to enter the heat exchanger and at least two outlet ports can be configured to allow the second fluid to exit the heat exchanger. Each inlet port and outlet port of the second fluid positioned through a respective tent. The inlet ports of the second fluid can be separated by the wall and the outlet ports of the second fluid can be separated by the wall.

The inlet ports for the first fluid can be on an opposing end of the inlet ports for the second fluid. The outlet ports for the first fluid can be on an opposing end of the outlet ports for the second fluid. The first fluid can include a cooling fluid and the second fluid can be configured to transfer heat to the first fluid within the counterflow sections.

The heat exchanger can include alternating heat exchange plates that include a cold layer with the first fluid flowing therethrough, the first fluid including a cooling fluid, the cold layer having inlet ports through respective tents at a first end and outlet ports through respective tents at a second end. The inlet ports of the first fluid are aligned facing away from each other, such that the first fluid entering from each respective inlet port is separated through the counterflow section. The heat exchanger can include alternating heat exchange plates include a hot layer with the second fluid flowing therethrough, the second fluid configured to transfer heat from the cooling fluid, the hot layer having inlet ports through respective tents at a second end and outlet ports through respective tents at a first end. The inlet ports of the second fluid are aligned facing away from each other, such that the second fluid entering from each respective inlet port is separated through the counterflow section.

At one end of the counterflow sections each tent can include a header and wherein at an opposing end of the counterflow sections, two tents share a single header separated by the wall. The heat exchanger can comprise four counterflow sections and a wall separating each counterflow section.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 2:
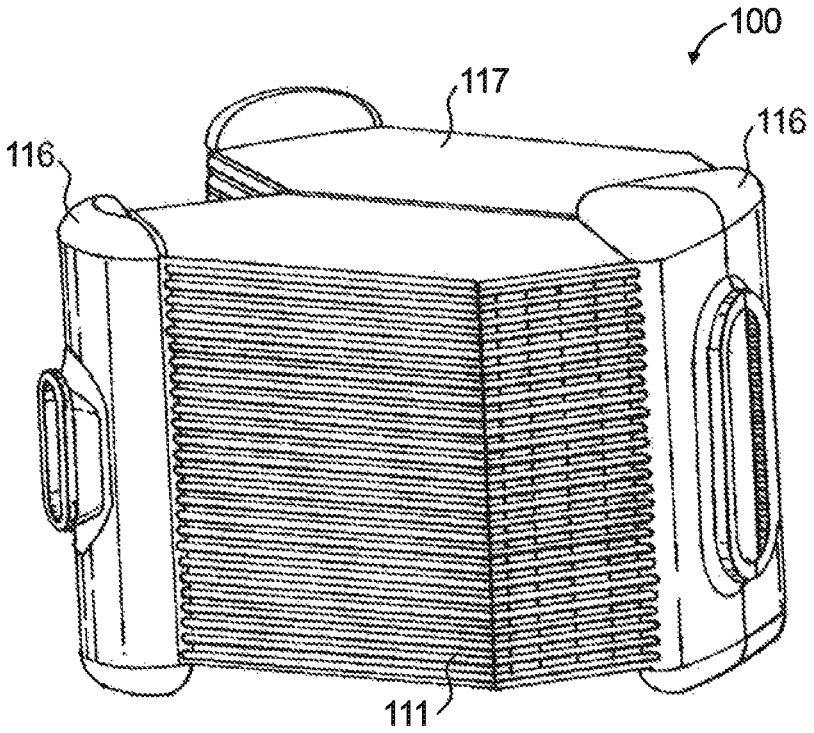
FIG. 2 is a perspective view of an exemplary embodiment of a heat exchanger constructed in accordance with the present disclosure, showing heat exchanger plates in a stacked arrangement with inlet and outlet ports.

Reference will now be made to the drawings wherein like reference numerals identify similar structural features or aspects of the subject disclosure. For purposes of explanation and illustration, and not limitation, a partial view of an exemplary embodiment of a counterflow heat exchanger in accordance with the disclosure is shown in FIG. 2 and is designated generally by reference character 100. Other embodiments of the counterflow heat exchanger in accordance with the disclosure, or aspects thereof, are provided in FIGS. 3*a*-4, as will be described.

Figure 1A:
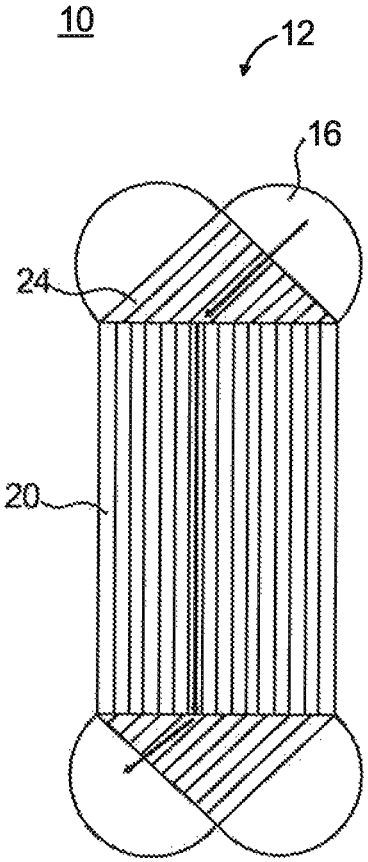
Fig. 1a (Prior Art)
FIG. 1*a* is a cross-sectional view of a heat exchanger plate of the prior art, showing a hot layer with angled tent sections.
Figure 1B:
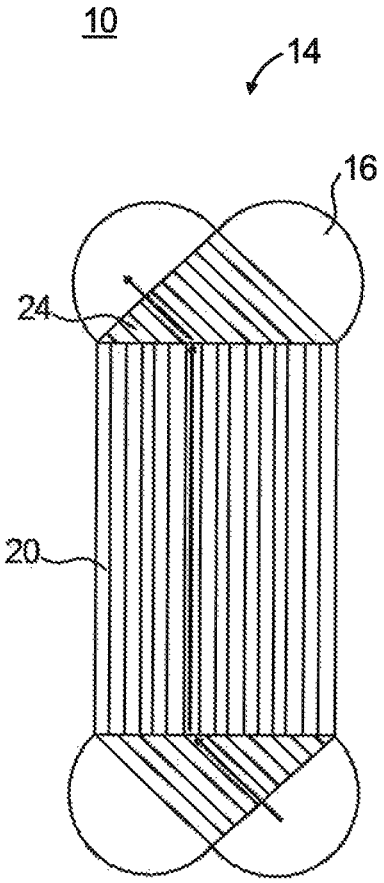
Fig. 1b (Prior Art)
FIG. 1*b* is a cross-sectional view of a heat exchanger plate of the prior art, showing a cold layer with angled tent sections.

Counterflow heat exchanger designs require tents at an angle relative to the counterflow core section to allow the flow to enter and exit the counterflow core section of the heat exchanger. The hot and cold layers of prior art design are shown in FIGS. 1*a* and 1*b*. Prior art counterflow heat exchangers include hot and cold layers 12, 14 attached to a parting sheet (not shown) that separates the hot and cold fluids. The heat exchanger is comprised of a cold layer including cold fins, a hot layer including hot fins and a parting sheet therebetween. This assembly is stacked one atop another to form a core with headers 16 attached to the core and arranged such that a cooling fluid enters at one end while a hot fluid enters on an opposing end, while allowing the hot and cooling fluids to flow in opposing directions to one another over a substantial portion of the core. This method of getting flow into and out of a counterflow heat exchanger optimizes heat transfer for a given amount of heat transfer surface area by ensuring that all fluid flow paths have essentially the same length, achieving essentially uniform flow through each flow passage of the heat exchanger. As shown in FIGS. 1*a* and 1*b* the prior art consists of a single counterflow section 20 with one tent section 24 at each end of the counterflow section 20. The tent sections 24 are comprised of multiple tent flow channels.

Figure 3A:
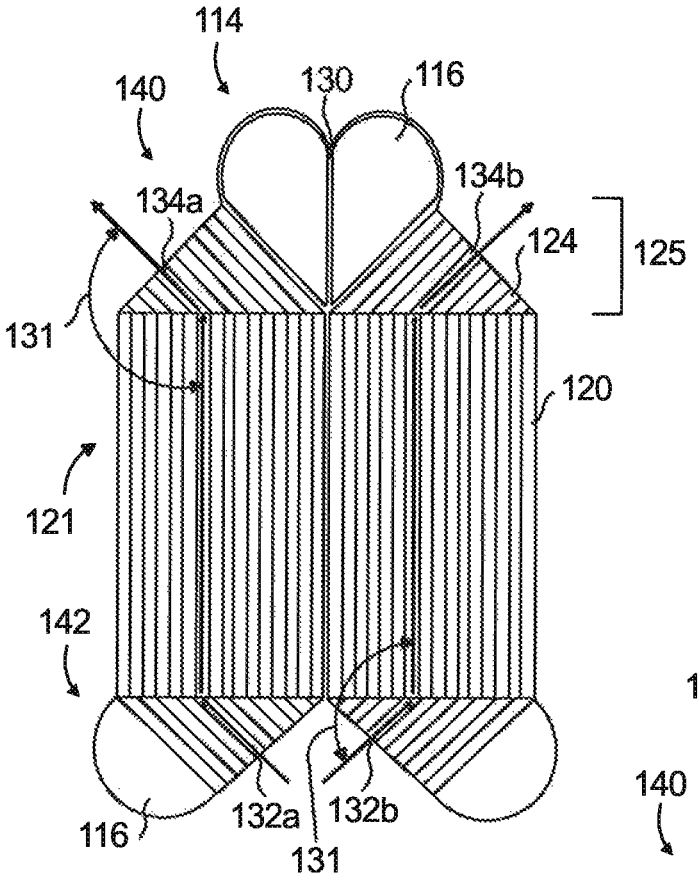
FIG. 3*a* is a cross-sectional view of a second layer plate of FIG. 2, having multiple angled tent sections on both ends of a cold layer of a counterflow core section.
Figure 3B:
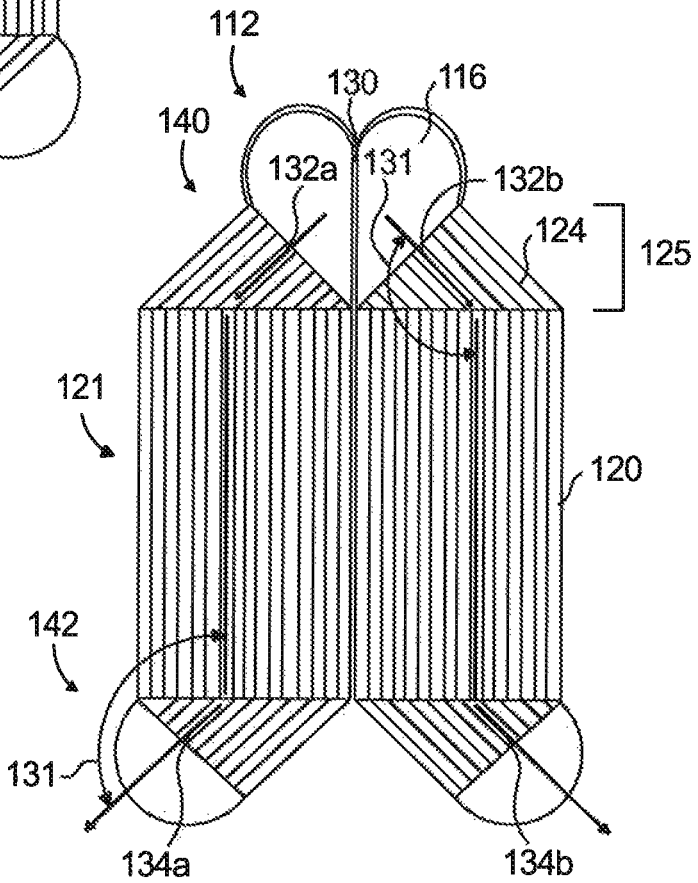
FIG. 3*b* is a cross-sectional view of a first layer plate of FIG. 2, having multiple angled tent sections on both ends of a hot layer of a counterflow core section.

With reference to FIGS. 2-3*b*, the present disclosure includes a heat exchanger 100 having smaller diameter headers 116 containing the highest pressure fluid to minimize header thickness (not shown), reducing heat exchanger weight and simplifying the design from a structural standpoint. High pressure heat exchangers often must have a minimum number of fins (not shown) per unit flow width to contain the high pressures, and this minimum fin density must exist throughout the heat exchanger, i.e., in both the core 117 and tent sections 124 of the heat exchanger.

To maintain practical duct sizes to channel fluid to and from the heat exchanger 100, a narrow tent section width 125 is desirable; however, because a minimum distance between fins (not shown) must be maintained throughout the core 117 and tent sections 124 for structural reasons, pressure drop through the tent sections 24 of prior art counterflow heat exchangers 10 is often high, resulting in an undesirably large heat exchanger volume and weight. The reduced flow length of multiple tent sections 124 in a heat exchanger plate 111 as well as the reduction in the amount of total fluid flow passing through each tent section 124 results in reduced pressure drop in the tent sections 124 relative to the pressure drop in the tent sections 24 of prior art heat exchangers 10.

With continued reference to FIG. 2 a perspective view of the heat exchanger 100 of the present disclosure is shown. The heat exchanger 100 includes a plurality of heat exchanger plates 111 in a stacked arrangement. Each heat exchanger plate 111 includes a first layer 114 (i.e, a cold layer) (see FIG. 3*a*) with cold fluid flowing therethrough and a second layer 112 (i.e., a hot layer) (see FIG. 3*b*) with a hot fluid flowing therethrough. The plates 112, 14 are stacked to form a core 117 of the heat exchanger 100. The hot and cold layers are physically separated by a parting sheet (not shown). The fluid flow passages in the hot and cold layers 112, 114 are arranged such that the hot fluid flowing through the hot layer is configured to exchange heat between the cooling fluid flowing through the cold layer. As shown in FIGS. 3*a*-3*b*, counterflow sections 120 comprise an intermediate portion 121 of heat exchange plates 111 where the heat exchange occurs. In contrast to the prior art design shown in FIGS. 1*a* and 1*b*, each layer 112, 114 of the heat exchanger 100 includes multiple counterflow sections 120 positioned adjacent each other with multiple tent sections 124 on each end. The tents sections 124 of heat exchanger 100 are relatively shorter in length than those shown in prior art 10 which reduces pressure drop for a given rate of fluid flow through the tent sections 124. The tent sections 124 are configured to angle 131 the flow direction of the first and second fluids in the tent sections 124 relative to the flow direction in the counterflow sections 120. With continued references to FIGS. 3*a*-3*b*, on one end 140 of each layer 112, 114 the tent sections 124 share a header 116 and on an opposing end 142 each tent section 124 has an individual header section 116. When the plates 111 are stacked into a core 117, the individual headers 116 combine to form continuous flow paths to channel hot and cooling fluid to and from the heat exchanger core 117. Two tent sections 124 sharing a single header 116 reduces the number of headers 116 needed and therefore reduces weight and cost of the heat exchanger 100 relative to the prior art. A solid wall 130 is positioned between the tent sections 124 and continues adjacent the counterflow core sections 120 for each layer 112, 114.

Each of the layers 112, 114 includes inlet ports 132*a*, 132*b* within respective tent sections 124 configured to allow the respective fluid to enter the counterflow section 120 and two outlet ports 134*a*, 134*b* within respective tent sections 124 configured to allow the respective fluid to exit the counterflow section 120. As shown in FIG. 3*a*, the cold layer 114 includes two inlet ports 132*a* and 132*b* at one end 142 (i.e. a first end) where the inlet ports 132*a*, 132*b* are positioned along a surface of the respective tent 124. The cooling fluid enters and flows through the counterflow section 120 and then exits outlet ports 134*a* and 134*b* at the opposing end 140 (i.e. a second end) along a surface of the respective tent 124. As shown in FIG. 3*b*, the hot layer 112 includes two inlet ports 132*a* and 132*b* through respective tents 124 and header 116 at the second end 140. The hot fluid flows through the counterflow section 120, in the opposite direction of the cold fluid, and exits outlet ports 134*a* and 134*b* at the first end 142 through respective tents 124 and headers 116. It will be understood by those skilled in the art that while the flow directions are shown in a specific configuration in FIGS. 3*a*, 3*b* and 4 the flow directions can be changed between the hot and cold layers without departing from the scope of the present disclosure.

The inlet and outlet ports 132*a*, 132*b*, 134*a*, 134*b* are aligned facing away from each other and directing the respective fluid into the respective counterflow sections 120. The wall 130 is continuous along the entire counterflow sections 120 (in the direction of the stacked layers) to hold the high pressure headers 116 on the heat exchanger 100. The wall 130 provides a load path by allowing the pressure forces acting on high pressure headers 116 on one end (e.g., second end 140) to react against the forces on high pressure headers 116 on the other end (e.g., first end 142). This allows for the hoop stress to be met with reduced thickness and weight.

Figure 4:
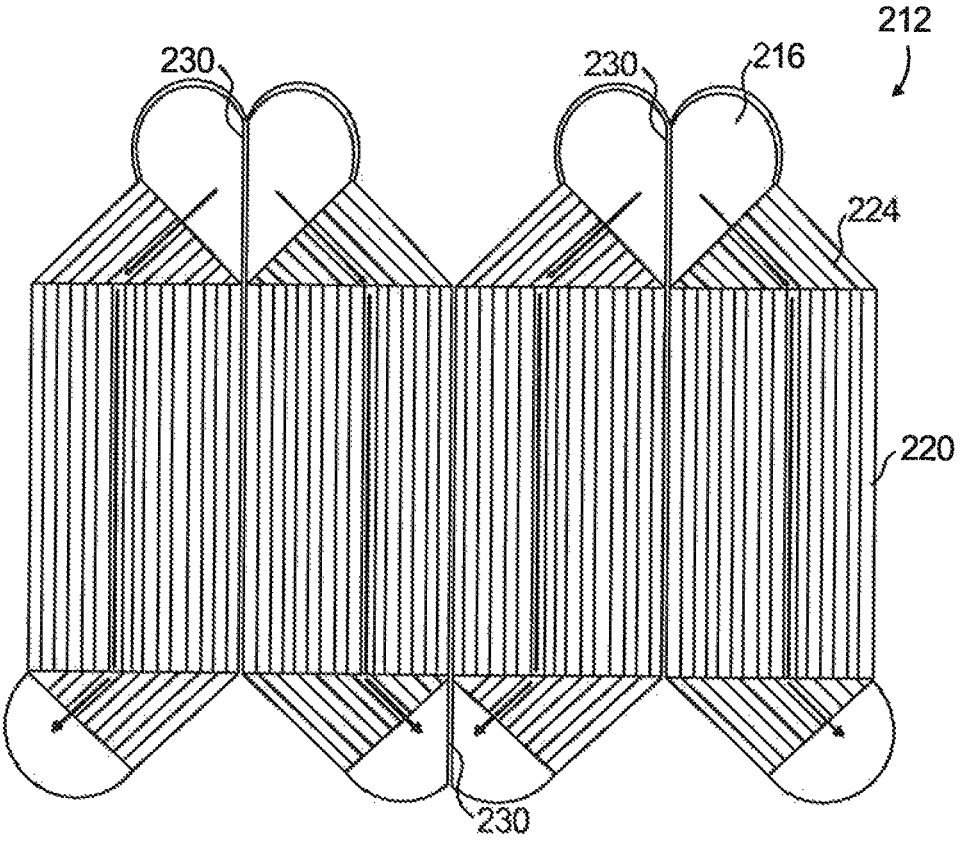
FIG. 4 is an alternate embodiment of a single first or second hot and cold layer of a heat exchanger constructed in accordance with the present disclosure, with a tent section on each end of each core section.

FIG. 4, illustrates a further embodiment of a counterflow heat exchanger. FIG. 4 shows a hot layer 212 but it will be understood that a cold layer will include similar structure in keeping with the disclosure. As shown in FIG. 4, four counterflow sections 220 are positioned adjacent each other. With the combination of additional counterflow sections 220, an additional header 216 combines two tents 224. Three walls 230 are positioned between each of the counterflow sections 220. As the number of counterflow sections increases, the tents 124 of heat exchanger decrease in length and are relatively shorter in length than as in the embodiment of FIGS. 3*a* and 3*b*. As described above, this also reduces flow through the tents which reduces the pressure drop of the tents relative to the pressure drop of the tents of a prior art device with only one tent section on each end of the counterflow section.

The methods and systems of the present disclosure, as described above and shown in the drawings, provide for counterflow heat exchanger with superior properties including reducing tent length and fin density. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A heat exchanger, comprising:

a plurality of heat exchanger plates in a stacked arrangement;

at least two counterflow sections positioned adjacent each other, the at least two counterflow sections comprising an intermediate section of each heat exchanger plate of the heat exchanger plates, the heat exchanger plates configured to transfer heat between a first fluid and a second fluid flowing in opposite directions from each other through a heat exchanger plate of the plurality of heat exchanger plates;

at least one tent section on each end of each counterflow section of the at least two counterflow sections, each of the tent sections of the at least one tent section directing inlet flow and outlet flow of the first fluid parallel to each other and at equally oblique angle relative to a flow direction in the at least two counterflow sections and the at least one tent section directing inlet flow and outlet flow of the second fluid parallel to each other and at equally oblique angle relative to the flow direction in the counterflow sections;

at least a first pair of inlet ports configured to allow the first fluid to enter the heat exchanger and at least a first pair of outlet ports configured to allow the first fluid to exit the heat exchanger, each inlet port of the at least a first pair of inlet ports and each outlet port of the at least a first pair of outlet ports positioned through a tent section of the at least one tent section;

at least a second pair of inlet ports configured to allow the second fluid to enter the heat exchanger and at least a second pair of outlet ports configured to allow the second fluid to exit the heat exchanger, each inlet port of the at least a second pair of inlet ports and each outlet port of the at least a second pair of outlet ports positioned through a tent section of the at least one tent section;

a first pair of headers, wherein each of the headers of the first pair are joined by a shared wall positioned between the first pair of headers and which continues adjacent along a length of the at least two counterflow sections; and a second pair of headers not in contact with each other and not in direct contact with the shared wall.

2. The heat exchanger of claim 1, wherein the at least a first pair of inlet ports are on an opposing end of the at least a second pair of inlet ports and wherein the at least a first pair of outlet ports are on an opposing end of the at least a second pair of outlet ports.

3. The heat exchanger of claim 2, wherein the first fluid includes a cooling fluid and the second fluid is configured to transfer heat to the first fluid within the at least two counterflow sections.

4. The heat exchanger of claim 3, wherein the heat exchanger plates are comprised of a first layer for the first fluid and a second layer for the second fluid to flow therethrough, the first and second layers being positioned adjacent within the stacked arrangement of the heat exchanger.

5. The heat exchanger of claim 1, wherein each of the second pair of headers has a curve.

* * * * *